US006173639B1

(12) United States Patent
A'Hearn et al.

(10) Patent No.: US 6,173,639 B1
(45) Date of Patent: Jan. 16, 2001

(54) FLUID CONTROL SYSTEM HAVING FLOAT CONTROL

(75) Inventors: Michael A. A'Hearn, Shorewood; Thomas J. Hajek, Jr., Lockport; Srikrishnan T. Tolappa, Aurora, all of IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/307,167

(22) Filed: May 7, 1999

(51) Int. Cl.[7] ..... F15B 11/024
(52) U.S. Cl. ..... 91/437; 91/447
(58) Field of Search ..... 91/437, 438, 447, 91/445, 33

(56) References Cited

U.S. PATENT DOCUMENTS 3,381,587 * 5/1968 Parquet ..... 91/420
3,965,587 * 6/1976 Johns ..... 37/8
5,331,882 7/1994 Miller ..... 91/461

* cited by examiner

*Primary Examiner*—F. Daniel Lopez
*Assistant Examiner*—Thomas E. Lazo
(74) *Attorney, Agent, or Firm*—J. W. Burrows

(57) ABSTRACT

A fluid control circuit providing a float capability for a double-acting actuator having first and second actuating chambers is provided. The fluid circuit includes signal controlled load check valves disposed between the actuating chambers and a directional control valve. The directional control valve is movable from a centered, neutral position towards first and second operative positions and a float position. The directional control valve and the load check valves are cooperatively operable in one operable position to allow fluid flow from the first actuating chamber to the exhaust port, and fluid flow from the pump port to the second actuating chamber. In the float position of the directional control valve, both of the signal controlled load check valves are opened to allow open fluid flow between the first and second actuating chambers thus allowing the tool attached to the actuator to float.

8 Claims, 1 Drawing Sheet

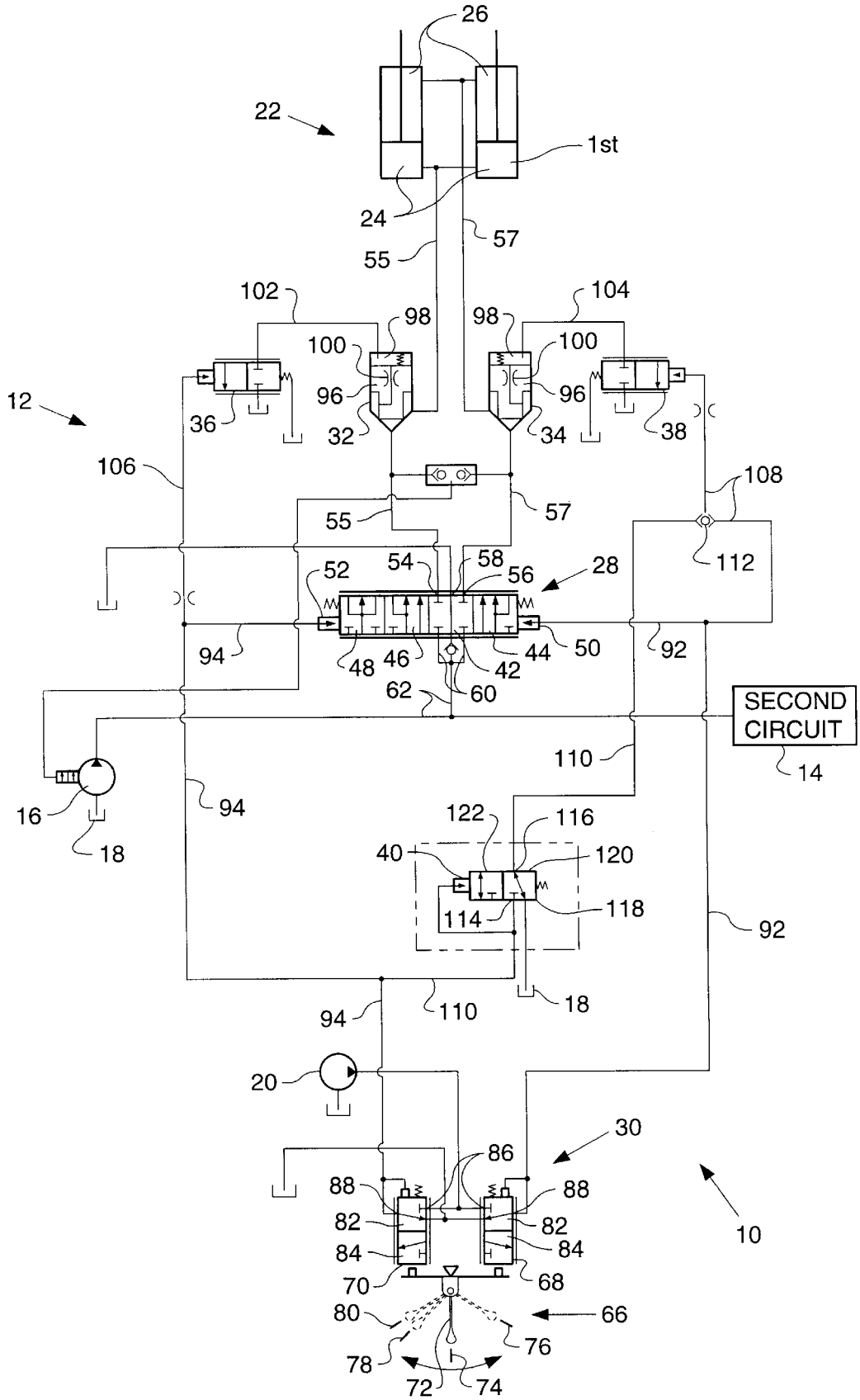
26
22
1st
24
57
55
102
104
98
98
100
100
96
96
12
36
32
34
38
106
108
55
57
112
52
54
58
56
28
94
48
46
44
50
92
42
62
60
SECOND CIRCUIT
110
14
16
94
18
122
116
40
120
118
114
92
94
110
18
20
30
86
88
88
82
82
84
84
10
70
68
80
66
76
78
72
74

FLUID CONTROL SYSTEM HAVING FLOAT CONTROL

TECHNICAL FIELD

This invention relates generally to a fluid system having a fluid control circuit for a lift actuator of a bucket of a loader or the like, and more articularly, to a fluid control circuit having a float function.

BACKGROUND ART

Fluid control systems including a float function, that is, the ability for fluid to move between opposite ends of actuator under equalized pressure conditions to provide a ground following capability, are well known. Typically however, the known systems do not provide load check valves between the directional control valve and the actuator. When load check valves are disposed therein it is necessary to provide an arrangement that not only provides the float function but also unseats the load check valves. Additionally, it is desirable to provide a circuit that provides zero leak or at least substantially zero leak from the actuator. In order to help ensure at least low leakage, a closed center directional control valve is normally used as opposed to an open center directional control valve.

Accordingly, the present invention is directed to overcoming one or more of the problems as set forth above.

DISCLOSURE OF THE INVENTION

In one aspect of the present invention, a fluid control circuit is provided for use in a fluid control system to permit an actuator to float. The fluid control circuit includes a source of pressurized fluid connected to a reservoir, a source of pressurized pilot fluid, and a fluid actuator having first and second fluid actuating chambers. The fluid control circuit includes a pilot operated directional control valve disposed between the source of pressurized fluid and the first and second fluid actuating chambers of the fluid actuator and being operative to control the flow of fluid to and from the actuator. The directional control valve is movable from a centered, neutral position towards first and second operative positions and a float position. A pilot control arrangement is included and has an input control arrangement. The pilot control arrangement is connected to the pilot operated directional control valve and operative to move the directional control valve from its neutral position towards the first and second operative positions and the float position in response to receiving a signal from the input control arrangement. A first pilot controlled load check valve is disposed between the directional control valve and the first fluid actuating chamber of the fluid actuator and a second pilot controlled load check valve disposed between the directional control valve and the second fluid actuating chamber of the fluid actuator. Each of the first and second pilot controlled load check valves is respectively opened in response to the directional control valve being moved towards the first and second operative positions. Both of the first and second pilot controlled load check valves are simultaneously opened in response to the directional control valve being moved to its float position.

BRIEF DESCRIPTION OF THE DRAWING

The sole drawing is a schematic illustration of an embodiment of the present invention.

BEST MODE FOR CARRYING OUT THE INVENTION

A fluid control system 10 is provided and includes first and second circuits 12,14, a source of pressurized fluid 16 connected to a reservoir 18, and a source of pressurized pilot fluid 20. The first circuit includes an actuator 22, shown as a pair of actuators, having first and second fluid actuating chambers 24,26, a directional control valve, such as a pilot operated directional control valve 28, a pilot control arrangement 30, first and second signal controlled load check valves, such as second pilot controlled load check valves 32,34, first and second vent valves 36,38, and a sequence valve 40. In the subject arrangement, a pair of actuators 22 are shown but only one actuator will be discussed hereafter. It is recognized that one or two actuators could be used in the subject embodiment. Likewise, the directional control valve, the first and second signal controlled load check valves, and the first and second vent valves could be controlled electrically, mechanically or hydraulically.

The pilot operated directional control valve 28 is disposed between the source of pressurized fluid 16 and the actuator 22 and is movable from a spring biased centered, neutral position 42 towards first and second operative positions 44,46 and a float position 48. The pilot operated directional control valve 28 has opposed ends 50,52, a first outlet port 54 connected via conduit 55 to the first fluid actuating chamber 24 of the actuator 22, a second outlet port 56 connected via conduit 57 to the second fluid actuating chamber 26 of the actuator 22, an exhaust port 58 connected to the reservoir 18, and a pressure inlet passage 60 connected to the source of pressurized fluid by a supply conduit 62.

At the centered, neutral position 42 of the directional control valve, the first and second outlet ports 54,56 and the pressure inlet passage 62 are blocked from each other. At the first operative position 44 thereof, the first outlet port 54 is connected with the pressure inlet passage 62 and the second outlet port 56 is connected with the exhaust port 58. At the second operative position 46 thereof, the second outlet port 56 is connected with the supply inlet passage 62 and the first outlet port 54 is connected with the exhaust port 58. At the float position 48 thereof, the first and second outlet ports 54,56 and the exhaust port 58 are interconnected.

The pilot control arrangement 30 includes an input control arrangement 66 and first and second pilot control valves 68,70. The input control arrangement 66 includes an operator input member 72 that is movable in response to the operator from a neutral position 74 towards a first operative position 76, a second operative position 78, and a float position 80. Each of the first and second pilot control valves 68,70 is spring biased to a first position 82 and movable towards a second position 84 in response to movement of the lever 74. Each of the first and second pilot control valves 68,70 also has an inlet port 86 connected to the source of pressurized pilot fluid 20, an outlet port 88, and an exhaust port 90 connected to the reservoir 18. The outlet port 88 of the first pilot control valve 68 is connected to the one opposed end 50 of the directional control valve 28 via pilot conduit 92 and the outlet port 88 of the second pilot control valve 68 is connected to the other opposed end 52 of the directional control valve via pilot conduit 94.

The first pilot controlled load check valve 32 is disposed in the conduit 55 and the second pilot controlled load check valve 34 is disposed in the conduit 57. Each of the first and second pilot controlled load check valves 32,34 normally permit fluid flow towards the actuator 22 and prohibits flow from the actuator 22. A valving element 96 is disposed in each of the pilot controlled load check valves 32,34 and a pressure chamber 98 is defined in each and in communication with the respective fluid actuating chambers 24,26 of the actuator 22 through respective orificed passages 100. Pressurized fluid in the respective pressure chambers 98 act to urge the respective valving elements 96 towards the closed position.

The first vent valve 36 is disposed in a pilot conduit 102 between the pressure chamber 98 thereof and the reservoir 18. The second vent valve 38 is disposed in a pilot conduit 104 between the pressure chamber 98 thereof and the reservoir 18. Each of the first and second vent valves 36,38 are spring biased to a first, flow blocking position. The first vent valve 36 is movable to a flow passing position in response to receipt of a pressure signal through the conduit 94 from the second pilot control valve 70 and a pilot conduit 106. The second vent valve 38 is movable to a flow passing position in response to receipt of a pressure signal through the conduit 92 from the first pilot control valve 68 and a pilot conduit 108.

The sequence valve 40 is disposed in a pilot conduit 110 and the conduit 110 is connected to the second pilot control valve 70 via a portion of the conduit 94 and connected to the second vent valve 38 through a resolver 112 and a portion of the pilot conduit 108. The sequence valve 40 has an inlet port 114 connected to the portion of the conduit 110 leading to the second pilot control valve 70, an outlet port 116 connected to the portion of the conduit 110 leading to the second vent valve 38 and an outlet port 118 connected to the reservoir 18. The sequence valve 40 is spring biased to a first position 120 and moved to a second position 116 in response to receipt of a predetermined pressure level of fluid from the second pilot control valve 70 through the pilot conduits 94,110.

It is recognized that various alternatives could be used in the subject first circuit without departing from the essence of the subject invention. For example, the pilot control arrangement 30 could be an electronic control with one or more of the first and second pilot control valves 68,70, the first and second vent valves 36,38, the sequence valve 40 and the directional control valve 28 being electrically controlled. Additionally, even though only a second circuit is shown additional circuits may be included in the fluid control system 10.

INDUSTRIAL APPLICABILITY

In the operation of the subject first fluid circuit, when the operator makes an input to the lever 74 towards the first operative position 66, pressurized pilot fluid is directed to the one end 50 of the directional control valve 28 moving it towards its first operative position 44. Simultaneously, the pressurized pilot fluid is directed through the conduit 108 and resolver 112 to the second vent valve 38 moving it to its flow passing position. Pressurized fluid is directed from the pressure inlet passage 60 of the directional control valve 28 to the first outlet port 54 and through the pilot controlled load check valve 32 to the first fluid actuating chamber 24 to extend the actuator 22. The fluid being exhausted from the second fluid actuating chamber 26 flows to the second pilot controlled load check valve 34 and passes through the orificed passage 100 into the pressure chamber 98, through the conduit 104 and across the open second vent valve 38 to the reservoir. In a well known manner, fluid flow across an orifice creates a resistive pressure. This resistive pressure acts to lift the valving element 96 thus permitting fluid to flow thereacross to the second outlet port 56 of the directional control valve 28 and on to the exhaust port 58.

In the same manner, if the operator makes an input to the lever 74 towards the second operative position 78, pressurized pilot fluid is directed to the opposed end 52 of the directional control valve 28 moving it towards its second operative position 46. In this case, pressurized fluid is directed from the pressure inlet passage 60 to the second outlet port 56, across the second pilot controlled load check valve 34 to the second actuating chamber 26 to retract the actuator 22. The fluid being exhausted from the first actuating chamber 24 flows to the first pilot controlled load check valve 32. The pressurized pilot fluid being directed to the opposed end 52 of the directional control valve 28 is simultaneously directed to the first vent valve 36 moving it to its second flow passing position. As previously noted with respect to the second pilot controlled load check valve 34, venting of the pressure chamber 98 permits the valving element 96 thereof to lift thus passing fluid thereacross to the first outlet port 54 of the directional control valve 28 and to the exhaust port 58.

When it is desired by the operator to provide a float mode of operation to actuator 22, the operator moves the lever 74 to its float position 80 which effectively increases the pressure of the fluid in the pilot conduit 94. The increased pressure in the conduit 94 moves the directional control valve 28 to its float position. The pressurized fluid in the pilot conduit 94 acts through the pilot conduit 106 to maintain the first vent valve 36 in its flow passing position. Simultaneously, the increased pressurized fluid in the pilot conduit 94 acts on and moves the sequence valve 40 to its second position 122. The pressurized pilot fluid is directed from the inlet port 114 to the outlet port 116, through the conduit 110, the resolver 112 to the second vent valve 38 moving it to its flow passing position. With the directional control valve 28 in its float position which interconnects the first and second outlet ports 54,56 with each other and the exhaust port 58 and both of the pilot controlled load check valves 32,34 movable to an open flow passing position, fluid flow is permitted to freely flow between the first and second fluid actuating chambers 24,26 of the actuator 22. Consequently, any tool attached to the actuator is free to follow the contour of the surface being worked.

In view of the foregoing, it is readily recognized that a fluid circuit 12 is provided which permits a float condition of an actuator 22 even though the directional control valve 28 has a flow blocking centered position and respective pilot controlled load check valves 32,34 are disposed in the fluid lines between the actuator 22 and the directional control valve 28.

Other aspects, objects and advantages of the present invention can be obtained from a study of the drawings, the disclosure and the appended claims.

What is claimed is:

1. A fluid circuit adapted for use in a fluid control system having a source of pressurized fluid connected to a reservoir, a source of pressurized pilot fluid, and a fluid actuator having first and second fluid actuating chambers, the fluid circuit comprising:

a directional control valve disposed between the source of pressurized fluid and the first and second fluid actuating chambers of the fluid actuator and being operative to control the flow of fluid to and from the actuator, the directional control valve being movable from a centered, neutral position towards first and second operative positions and a float position;

a signal control arrangement having an input control arrangement and being connected to the directional control valve and operative to move the directional control valve from its neutral position towards the first and second operative positions and the float position in response to receiving a signal from the input control arrangement; and a first signal controlled load check valve disposed between the directional control valve and the first fluid actuating chamber of the fluid actuator and a second signal controlled load check valve disposed between the directional control valve and the second fluid actuating chamber of the fluid actuator, each of the first and second signal controlled load check valves being respectively opened in response to the directional control valve being moved towards the first and second operative positions, and a sequence valve disposed between the signal control input arrangement and one of the signal controlled load check valves operative to simultaneously open both of the first and second signal controlled load check valves when the directional control valve is moved to its float position.

2. The fluid circuit of claim 1 including wherein the signal control input arrangement includes first and second operator actuated pilot control valves connected to the source of pressurized pilot fluid and being movable from a flow blocking position towards a flow passing position in response to operator input, the first pilot control valve being operative to hydraulically move the directional control valve towards its first operative position and to open the second signal controlled load check valve and the second pilot control valve being operative to hydraulically move the directional control valve towards its second operative position and the float position and to open the first signal controlled load check valve when the directional control valve is being moved towards its second operative position and operative through the sequence valve to also open the second signal controlled check valve when the directional control valve is being moved into its float position.

3. The fluid control circuit of claim 2 wherein each of the first and second signal controlled load check valves is a pilot controlled load check valve and has a valving element and a pressure chamber defined therein and being urged closed in response to pressurized fluid in the pressure chamber and opened in response to venting of the pressurized fluid from the pressure chamber and including a first vent valve being disposed between the pressure chamber of the first pilot controlled load check valve and the reservoir and a second vent valve being disposed between the pressure chamber of the second pilot controlled load check valve and the reservoir, the first vent valve being spring biased to a closed position and movable to an open position in response to receipt of a signal from the second pilot control valve and the second vent valve being spring biased closed and movable to an open position in response to receipt of a signal from the first pilot control valve.

4. The fluid circuit of claim 3 wherein the sequence valve is hydraulically actuated and is disposed between the second pilot control valve and the second vent valve and is movable from a first spring biased position at which the second pilot control valve is blocked from the second vent valve to a second position at which the second pilot control valve is in communication with the second vent valve in response to the pressurized fluid from the second pilot control valve acting to move the directional control valve to its float position.

5. A fluid circuit adapted for use in a fluid control system having a source of pressurized fluid connected to a reservoir, a source of pressurized pilot fluid, and a fluid actuator having first and second fluid actuating chambers, the fluid circuit comprising:

a pilot operated directional control valve having pressure chambers at opposed ends, a first outlet port connected to the first fluid actuating chamber of the fluid actuator, a second outlet port connected to the second fluid actuating chamber of the fluid actuator, a pressure inlet passage, and an exhaust port, the directional control valve being movable from a centered, neutral position towards first and second operative positions and a float position, at the neutral position, each of the first and second outlet ports, the pressure inlet passage and the exhaust port is blocked from one another, at the first operative position, the first outlet port is in communication with the pressure inlet passage and the second outlet port is in communication with the exhaust port, at the second operative position, the second outlet port is in communication with the pressure inlet passage and the first outlet port is in communication with the exhaust port, and at the float position, the first and second outlet ports are in open communication with the exhaust port and the pressure inlet passage is blocked therefrom;

a pilot control arrangement having an input control arrangement and first and second pilot control valves connected to the source of pressurized pilot fluid and being movable from a flow blocking position towards a flow passing position in response to movement of the input control arrangement, each of the first and second pilot control valves has an inlet port connected to the source of pressurized pilot fluid, an outlet port and an exhaust port, the outlet port of the first pilot control valve is connected to one of the opposed ends of the directional control valve and the outlet port of the second pilot control valve is connected to the other of the opposed ends;

a first pilot controlled load check valve is disposed between the first outlet port of the directional control valve and the first fluid actuating chamber of the fluid actuator and a second pilot controlled load check valve is disposed between the second outlet port and the second fluid actuating chamber of the fluid actuator, each of the first and second pilot controlled load check valves having a valving element and a pressure chamber defined therein and being urged closed in response to pressurized fluid in the pressure chamber and opened in response to venting of the pressurized fluid from the pressure chamber;

a first vent valve being disposed between the pressure chamber of the first pilot controlled load check valve and the reservoir and a second vent valve being disposed between the pressure chamber of the second pilot controlled load check valve and the reservoir, the first vent valve being spring biased to a closed position and movable to an open position in response to receipt of a signal from the second pilot control valve and the second vent valve being spring biased closed and movable to an open position in response to receipt of a signal from the first pilot control valve; and a sequence valve disposed between the second pilot control valve and the second vent valve, the sequence valve has an inlet port connected to the second pilot valve, an outlet port connected to the second vent valve and an exhaust port and movable between a first, spring biased position at which the inlet port is blocked and the outlet port is in communication with the exhaust port and a second position at which the exhaust port is blocked and the inlet port is in communication with the outlet port, the sequence valve is movable to its second position in response to a predetermined level of pressurized fluid being directed to the inlet port thereof from the second pilot valve.

6. The fluid control circuit of claim 5 wherein the input control mechanism is movable from a neutral position towards first and second operative positions and to a float position and the directional control valve is movable to its float position in response to the input control mechanism being moved to its float position.

7. The fluid control circuit of claim 6 wherein the sequence valve is movable to its second position simultaneous with the directional control valve being moved to its float position.

8. The fluid control circuit of claim 7 wherein the directional control valve is spring biased to its neutral position.

* * * * *